US006527066B1

(12) United States Patent
Rives

(10) Patent No.: US 6,527,066 B1
(45) Date of Patent: Mar. 4, 2003

(54) HOLE OPENER WITH MULTISIZED, REPLACEABLE ARMS AND CUTTERS

(76) Inventor: Allen Kent Rives, 11831 Pebbleton, Houston, TX (US) 77070

( * ) Notice: Subject to any disclaimer, the term of this patent is extended or adjusted under 35 U.S.C. 154(b) by 0 days.

(21) Appl. No.: 09/622,661

(22) PCT Filed: May 15, 2000

(86) PCT No.: PCT/US00/13268

§ 371 (c)(1),
(2), (4) Date: Aug. 21, 2000

(87) PCT Pub. No.: WO00/70184

PCT Pub. Date: Nov. 23, 2000

Related U.S. Application Data

(60) Provisional application No. 60/160,771, filed on Oct. 21, 1999, and provisional application No. 60/134,100, filed on May 14, 1999.

(51) Int. Cl.[7] ..... E21B 10/26

(52) U.S. Cl. ..... 175/344; 175/346; 175/347

(58) Field of Search ..... 175/344, 345, 175/346, 347, 366, 367, 368, 369, 53, 406

(56) References Cited

U.S. PATENT DOCUMENTS

| | | | | |
|---|---|---|---|---|
| 1,940,415 A | * | 12/1933 | Harrington et al. | 175/346 |
| 2,030,722 A | * | 2/1936 | Scott | 175/344 |
| 2,086,680 A | * | 7/1937 | Scott et al. | 175/344 |
| 2,093,632 A | * | 9/1937 | Catland | 175/344 |
| 2,103,583 A | * | 12/1937 | Howard et al. | 175/344 |
| 2,174,587 A | | 10/1939 | Love | |
| 2,557,619 A | | 6/1951 | Swart | |
| 3,917,011 A | | 11/1975 | Hester | |
| 4,007,799 A | | 2/1977 | Dixon et al. | |
| 4,036,314 A | | 7/1977 | Dixon et al. | |
| 4,141,421 A | | 2/1979 | Gardner | |
| 4,193,464 A | | 3/1980 | Dixon | |
| 5,992,542 A | | 11/1999 | Rives | |

OTHER PUBLICATIONS

Composite Catalog, Composite Catalog, Grant Hole Enlarger Model 6980, 1974–75, p. 2302, 31st Revision, vol. 2, World Oil, Houston, TX, US.

Composite Catalog, Composite Catalog, Hole Openers, 1974–75, p. 1732, 31st Revision, vol. 1, World Oil, Houston, TX, US.

Composite Catalog, Composite Catalog, Efficient Hole Enlargement, 1998–99, p. 28, 43rd Edition, vol. 1, World Oil, Houston, TX, US.

* cited by examiner

*Primary Examiner*—Hoang Dang
(74) *Attorney, Agent, or Firm*—David B. Dickinson; Lundeen & Arismendi, L.L.P.

(57) ABSTRACT

A hole opener (10) having a tubular body (11) with threaded ends (12, 14) for connection in a drill string. The hole opener provides slots or grooves (21, 21') along its longitudinal axis (16) into which are inserted cutter arm support members (30, 30', 60, 60') which may be screwed, (43) pinned (68) or bolted (168) to the body (11) to permit easy replacement of the support arms (30). The grooves (21, 21') in the body (11) of the hole opener (10) also provide a spindle (20) spatially aligned with the groove (21, 21') to support the proximal end of a rotatable journal body (28) supporting the cutter body (25) providing hard facing for grinding of the bore hole to be enlarged. The support arms (30) at their distal end provide further support for the cutter journals (70). The hole opener (10) also may provide pressure compensated lubrication mechanism (71) to provide grease to the bearing surfaces to increase their service life and thereby extend the useful life of the tool.

16 Claims, 13 Drawing Sheets

HOLE OPENER WITH MULTISIZED, REPLACEABLE ARMS AND CUTTERS

RELATED CASES

This application claims priority to my provisional patent applications, Application Ser. No. 60/134,100, filed May 14, 1999, and application Ser. No. 60/160,771, filed Oct. 21, 1999, for the same invention.

BACKGROUND-FIELD OF INVENTION

The present invention relates to an improved hole opener for use in increasing the diameter of holes in drilling and more specifically, to a hole opener having a set of arms that may be changed to increase the size of the cutter allowed to be used so that a variety of different sized holes might be drilled using the same hole opener body.

In the drilling industry, whether for exploration of oil and gas, mining, water well development or the like, an operator may desire to widen the existing diameter of a hole previously drilled. A number of prior art devices have been used for enlarging such holes. Most hole openers currently in use provide a fixed-arm arrangement which supports a pin through the cutter shell and are prone to failure when excessive wear allows the arm to fail and the pin to collapse, with the possibility that such devices might then be stuck in the hole, necessitating an expensive retrieval job.

SUMMARY OF THE INVENTION

The present invention provides a tubular body with threaded connections at either or both ends to enable connection in a drill string, and further providing a passage therethrough for the passage of drilling fluid, including air. The tubular body supports a plurality of detachable support arms for each cutter which are bolted, pinned, or otherwise removably attached to the tubular body and which engage the outer or distal end of a journal body. The journal body is engaged at its proximal end on a spindle providing an eccentric or otherwise non-circular profile so that the journal cannot be rotated on the spindle. Alternatively, the spindles may also be recessed in the tubular body providing additional structural support for the journals, and further providing a restraint to movement of the journal on the spindle. The journal provides bearings to facilitate rotation of a cutter on the journal. The cutter shell is carried on the journal body and eliminates the customary pin arrangement through the axis of rotation of the cutter body, which was used to support all known prior art hole openers. A pressure compensated means of lubricating the bearings on the journal is also provided thereby increasing the life of the bearings and the useful life of the hole opener.

DESCRIPTION OF THE INVENTION

The present invention is for a hole opener providing the means to use the tool for opening more than one diameter with the same tubular body by changing the support arm, the journal supported by that arm and the cutter shell.

Figure 1:
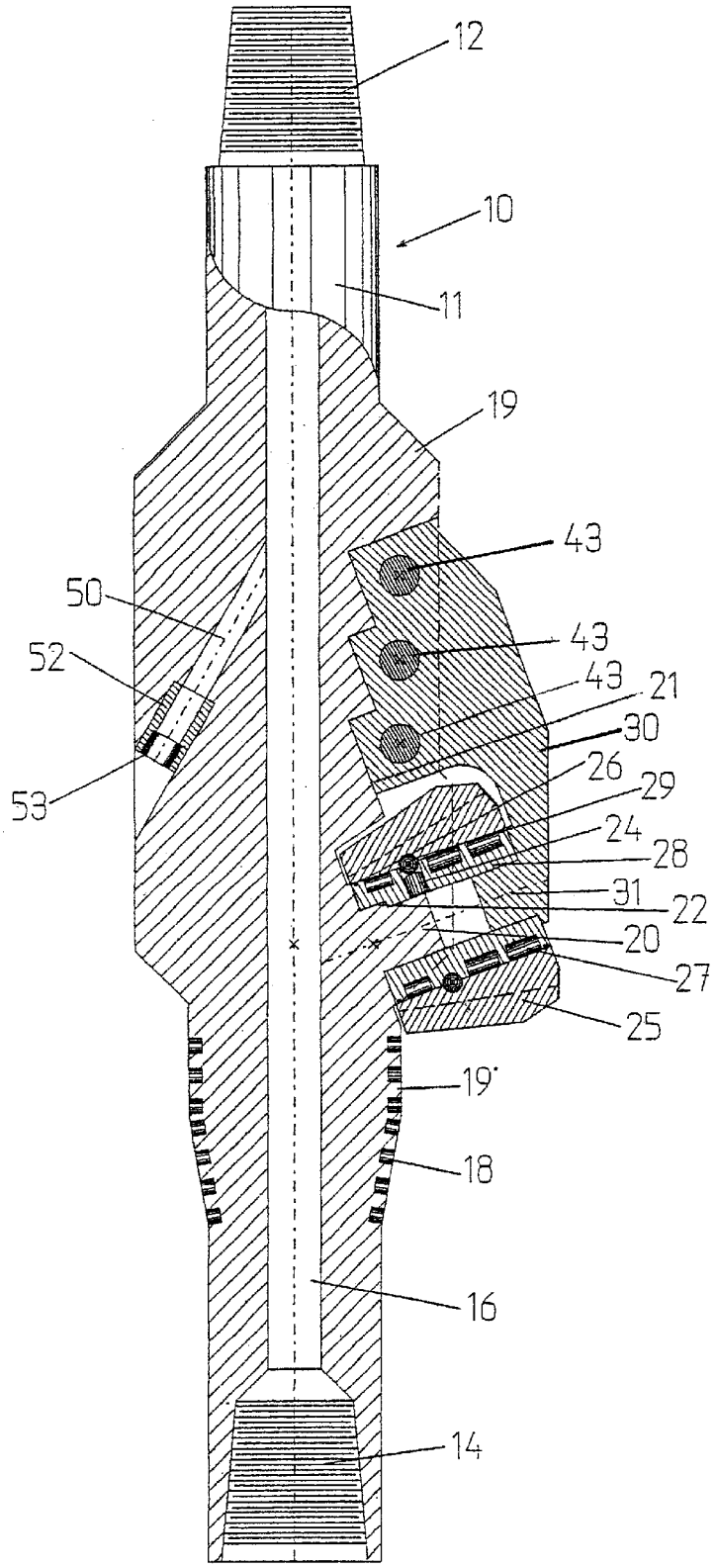
FIG. 1 is a side cut-away view of a form of the invention showing a smaller cutter shell and arm.

In FIG. 1, the hole opener 10 provides a threaded pin 12 and a threaded box 14 at the other end to connect the tubular body 11 to a drill string or the like (not shown). The tubular body 11 provides a passage 16 through its longitudinal extent to allow the passage of drilling fluid, which can be liquid or air used to carry the cuttings from the well bore (not shown). The tubular body 11 is integrally formed with a larger diameter portion 19. A stair-stepped groove or rabbet 21 extending from adjacent the larger diameter portion 19 to adjacent the eccentric spindle 20 formed on the body 11 to accept support arm 30. Support arm 30 is secured to the tubular body by a plurality of socket head cap screws 43, 43' and 43" of varying lengths that attach the support arm body 30 to the body 11. Each of the socket head cap screws is further secured in the support arm body 30 by retainer ring 45 which is inserted in a groove 45' formed on the interior surface of the support arm. The support arm body 30 provides a spindle 31, which fits into the space formed by a journal 28 at its distal end. Journal 28 is formed with an eccentric or non-circular profile 22 on its proximal end to mate with spindle 20 on the tubular body 11 to prevent rotation of the journal 28 in either direction, allowing the hole opener to be used in either direction. Journal 28 provides bearings 27 and bearing races 29 to facilitate rotational movement of cutter shell body 25 on the journal 28. Each of the cutter shells supported on the multiple support arms may be provided with hard facing in a manner well known to those skilled in the art, or may be provided with tungsten carbide buttons (not shown) also in a well known commercial manner. In the preferred embodiment, three support arm-cutter assemblies are provided on the hole opener 10, but any number greater than three may be provided depending on the size of the hole desired.

Adjacent the cutter shell spindle 20, the diameter of the body 11 is only increased to an amount equivalent to the smallest hole which the operator may wish to open and provides hard facing (not shown) or tungsten carbide buttons 18 to minimize wear on the tubular body 11 as it moves through the formation to be widened.

Tubular body 11 is additionally formed to provide passageway 50 which permits communication of the drilling fluid from the longitudinal passageway 16 to adjacent the cutter bodies through nozzle holder 52 and nozzle 53 in a manner well known in the drilling industry. The jetting nozzle 53 is recessed in the body of the largest diameter portion of the tubular body 11 spaced between each of the support arms.

Figure 2:
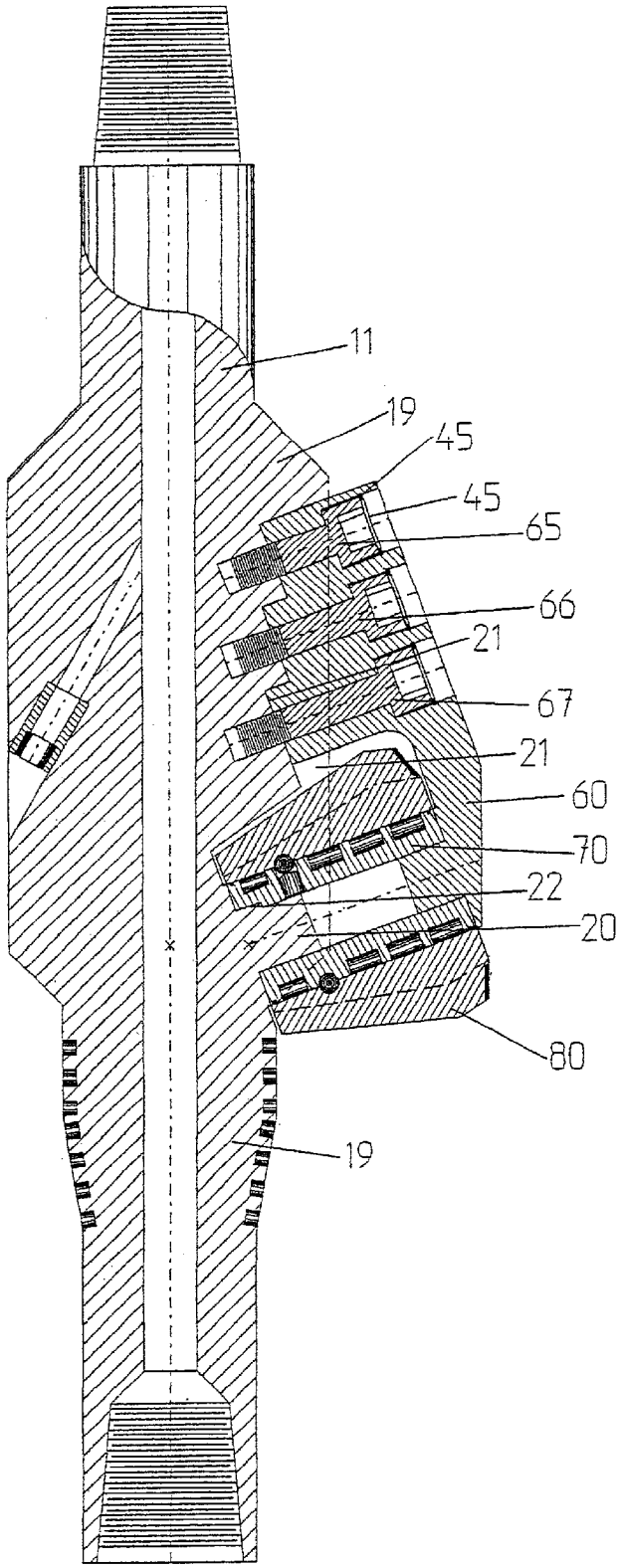
FIG. 2 is another cut-away view of a form of the invention showing the tubular body with a larger cutter shell and arm.

FIG. 2 describes the hole opener with the same sized body as shown in FIG. 1, with the larger support arm 60, journal 70 and cutter body 80 for widening the diameter of a larger hole with the same tubular body 11. The tubular body 11 may be fitted with alternative sets of support arms 60, larger journals 70, and larger cutter shells 80 for a variety of wider hole sizes desired. The socket head cap screws 65, 66, and 67 are longer to support the larger support arm 60 on the body, but otherwise function in the same manner and are installed on the body in the same manner as the bolts for the smaller diameter hole opener of FIG. 1. The function and operation of the hole opener would be equivalent to the hole opener described in connection with FIG. 1.

Figure 3:
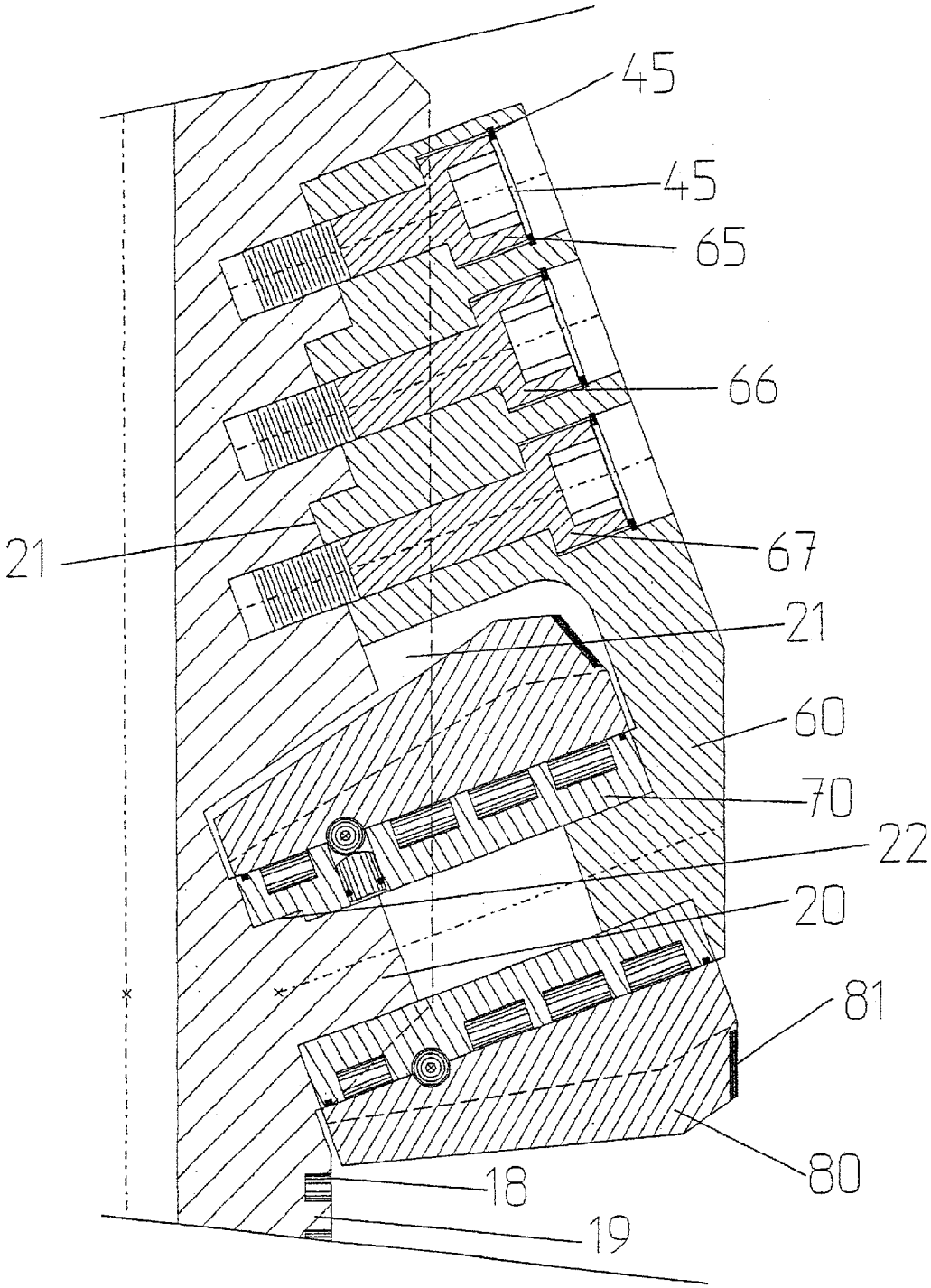
FIG. 3 is an enlarged cross-sectional view of the cutter support arm, journal and cutter shell supported on the tubular body.

FIG. 3 is an enlarged partial view of the hole opener of FIG. 2 showing the stair-stepped groove 21 formed in the large diameter portion body of the tubular body 11, with the socket head cap screws 65, 66, and 67, and retainer rings 45 seated in retainer ring grooves 45'. Cutter shell journal 70 provides additional roller bearings to support the additional cutting surface of the cutter shell 80 and facilitate rotational movement of the cutter shell on the journal. FIG. 3 more clearly shows the hard facing, which may be placed on the exterior surface 81 of the dihedral shaped cutter shell body. The face of cutter shell 80 may again be provided with either hard facing with grooves commonly referred to as a mill tooth cutter in the manner well known in the art or may provide tungsten carbide buttons (not shown).

Socket head cap screws 65, 66, and 67, shown in FIG. 3 are one side view of two adjacent rows of bolts (for a total of six bolts) securing the support arm 60 to the tubular body 11 in the stair-stepped groove 21, 21', fashioned in the largest diameter portion 19 of the body 11. Other arrangements of bolts and grooves may be made to the tool body without departing from the spirit of the invention made.

FIG. 3 further more clearly demonstrates the angle of the eccentric support spindle 20 from a normal (perpendicular) to the longitudinal axis of the tool. In prior art hole opener devices, the angle between the cutter axis and a plane perpendicular to the longitudinal axis of the tool supporting was approximately 30°; however, in the present device the angle of the spindle 20 to a perpendicular normal to the body 11 is approximately 20° or less. This lower angle requires less material be removed from the body to allow free rotation of the cutter. This additional material strengthens the overall body leading to longer service life and fewer failures in the field.

Figure 4:
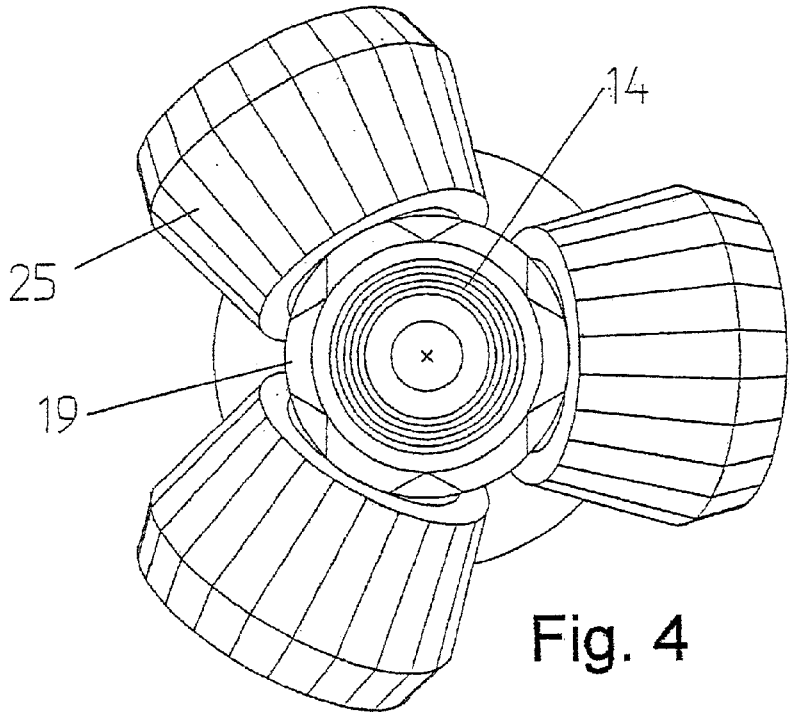
FIG. 4 is an end view of the small cutter shells on the tubular body.

FIG. 4 is a partial schematic description of the end view of the hole opener with the smaller cutter shell bodies of FIG. 1. This view clearly shows the dihedral shape of the cutter faces and the profile of the cutter in the hole. The profile of the hole opener 10 from the end demonstrates that the flow of drilling and fluids is not restricted with bracing or support for cutters permitting the free flow of drilling fluid and cuttings from the cutting face back along the periphery of the hole opener body 11 in the well bore annulus.

Figure 5:
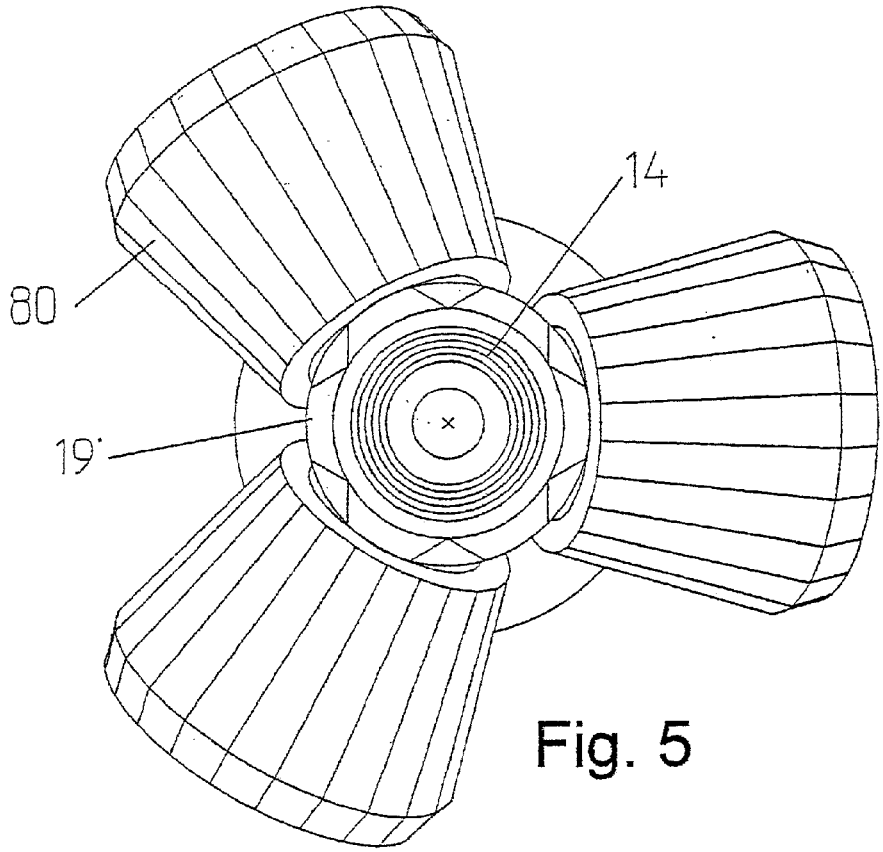
FIG. 5 is an end view of the larger cutter shells on the same tubular body shown in FIG. 4.

FIG. 5 is a similar schematic view of the end of FIG. 2 showing the larger cutter shells on the same hole opener body as FIG. 1 for opening a larger hole. Both FIG. 4 and FIG. 5 are shown without the tungsten carbide buttons shown in FIGS. 1, 2, and 3. As the cutter shells are enlarged the flow area around the cutter body is increased because the support arm only increase relative to the size of the cutter attached and does not encroach upon the fluid passage for the larger hole sizes.

Figure 6:
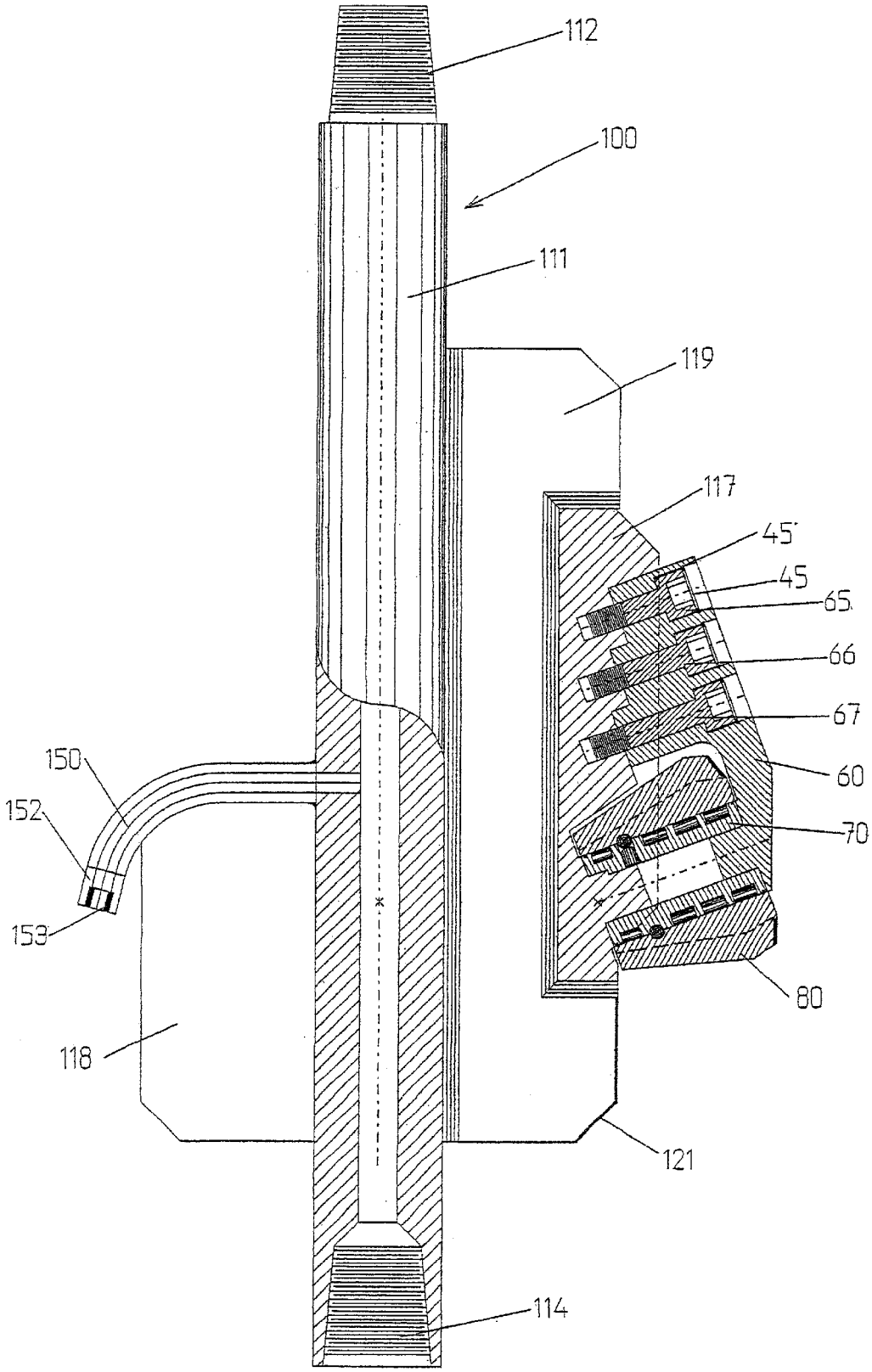
FIG. 6 is cross-sectional side view of an alternative embodiment for use in larger diameter holes.

FIG. 6 is a side view of a hole opener for use in large diameter holes, which functions in the same manner as the smaller diameter hole openers shown in FIGS. 1, 2 and 3. A spindle block support gusset 119 is permanently attached to tubular body 111 and spindle block 117 is affixed to said gusset. Threaded pins 112 and threaded boxes 114 are again provided to permit connection of the hole opener 100 in the drill string. The spindle support block provides the attachment support for socket head cap screws 65, 66, and 67 to attach the support arm body 60 identical to that used in either FIGS. 1 or 2. The cutter shell may be changed in a similar manner to go from a smaller diameter hole with hole opener 100 to a larger diameter hole by easily changing the support arm, journal and cutter shell as described herein.

Adjacent each spindle block support gusset, a pilot guide gusset 118 supporting a fluid spout 150, jetting nozzle holder 152 and jetting nozzle 153 may be permanently attached to the body of the hole opener permitting fluid communication from the longitudinal passage formed through the body 111 of the hole opener to provide means for carrying the cuttings from the cutters up the periphery of the body 111 through the annulus of the well bore (not shown). The pilot guide gusset may be hard faced to prevent wear in a manner well known to the drilling trades such as shown in 121.

Figure 7:
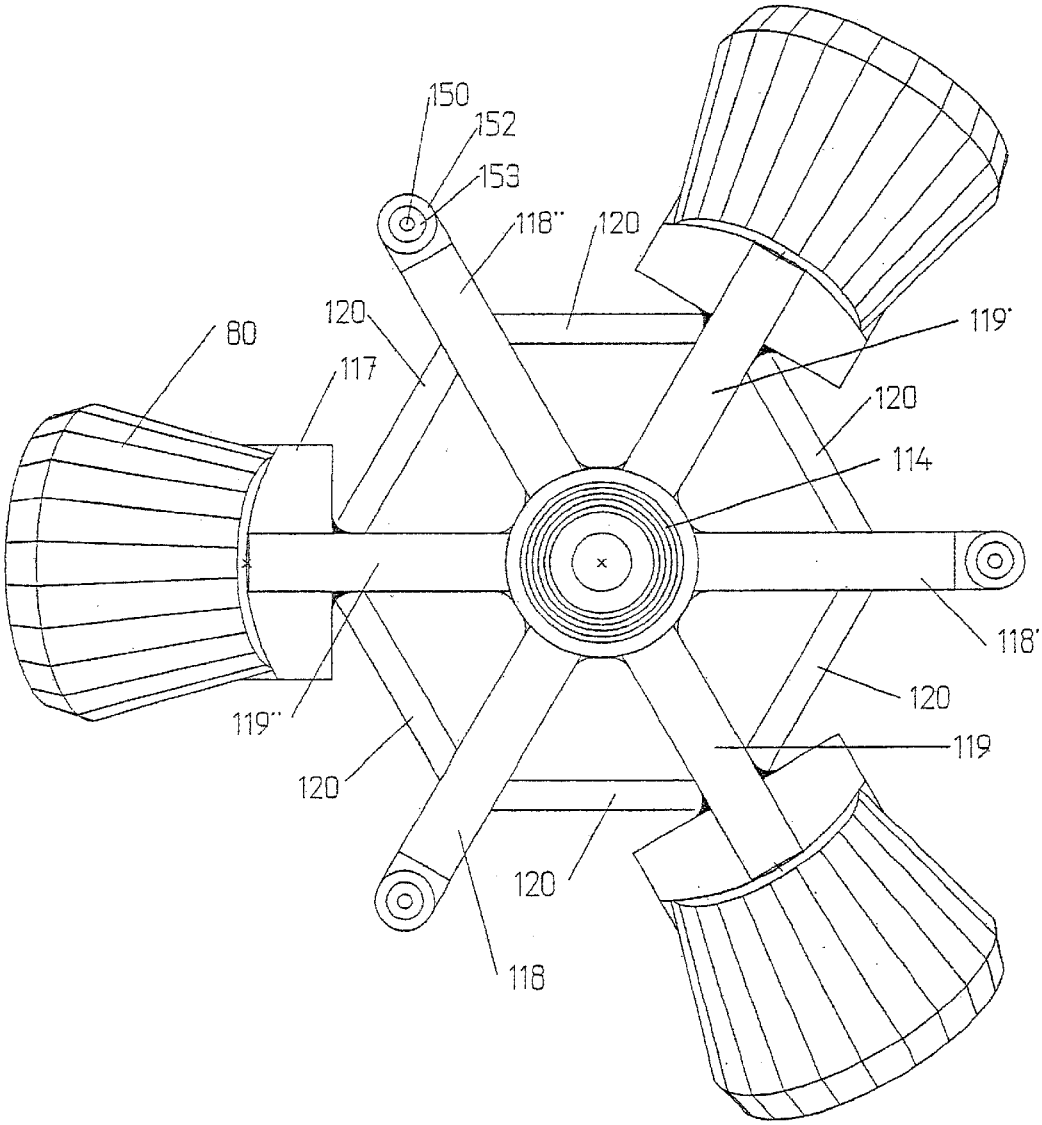
FIG. 7 is an end view of the large diameter hole opener of FIG. 6.

FIG. 7 shows an end view of the large diameter hole opener 100 with threaded box 114 at the center and disclosing the preferred arrangement of the three spindle support block gussets 119, 119' and 119" on which is affixed the spindle support block 117 into to which is attached the spindle support arms which provide engagement with the journals and cutters on said journals. Adjacent each of the three cutter support spindle blocks are the three fluid communication ports 150 with nozzle holder 152 and nozzle 153 supported on their respective pilot guide gussets 118, 118' and 118". Each of the support gussets may be connected by support gussets 120 to provide additional lateral support for the gussets.

Figure 8:
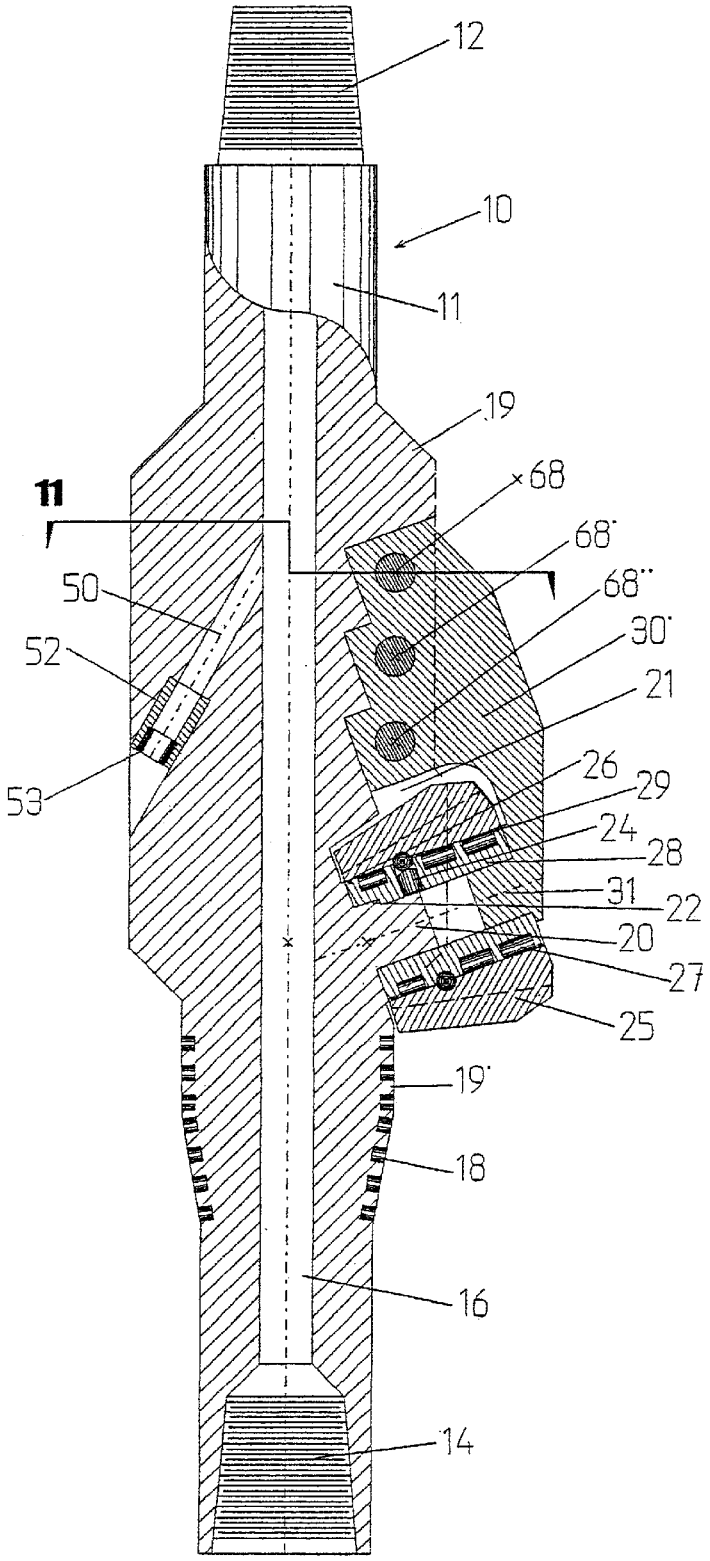
FIG. 8 is a sectional view of a second form of embodiment of the invention with a pinned cutter arm.
Figure 11:
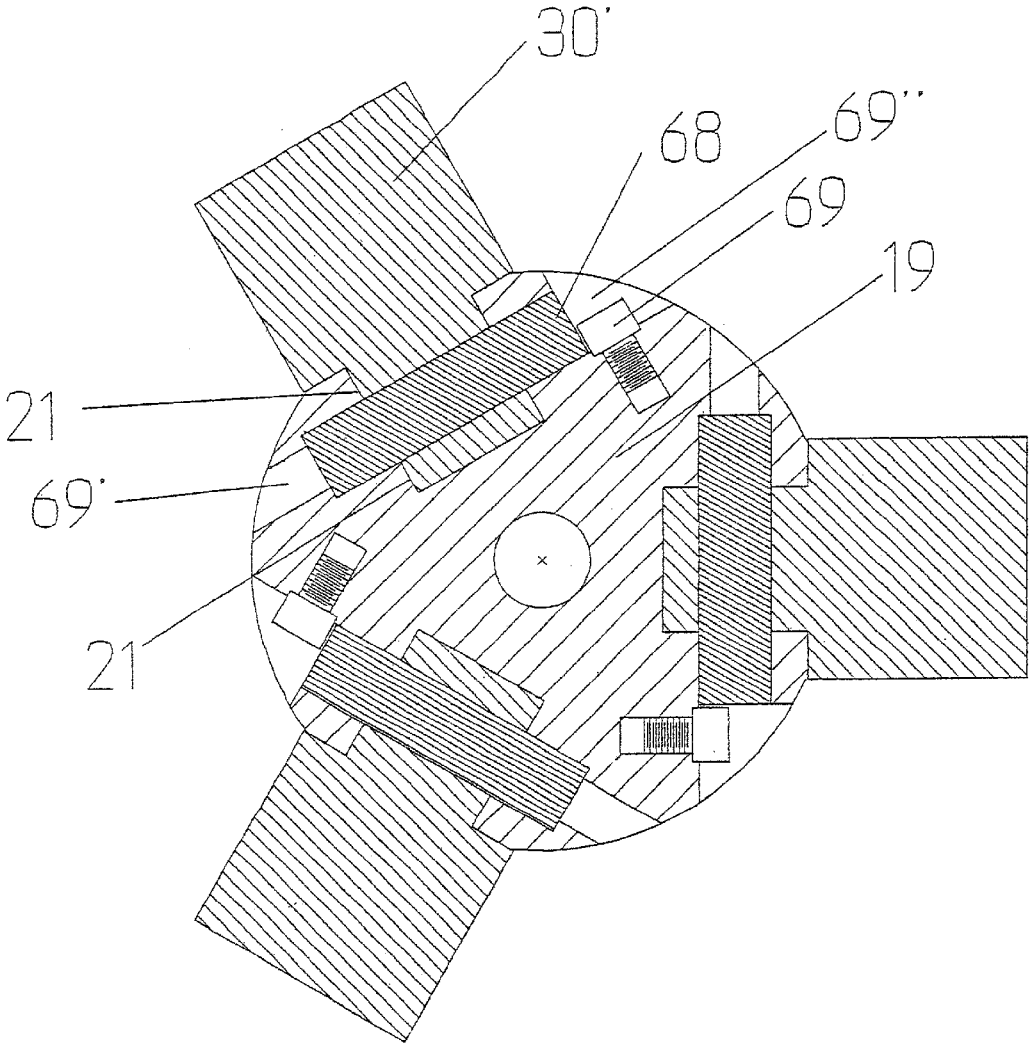
FIG. 11 is a sectional view of the cutter body through the section line of FIG. 8.
Figure 12:
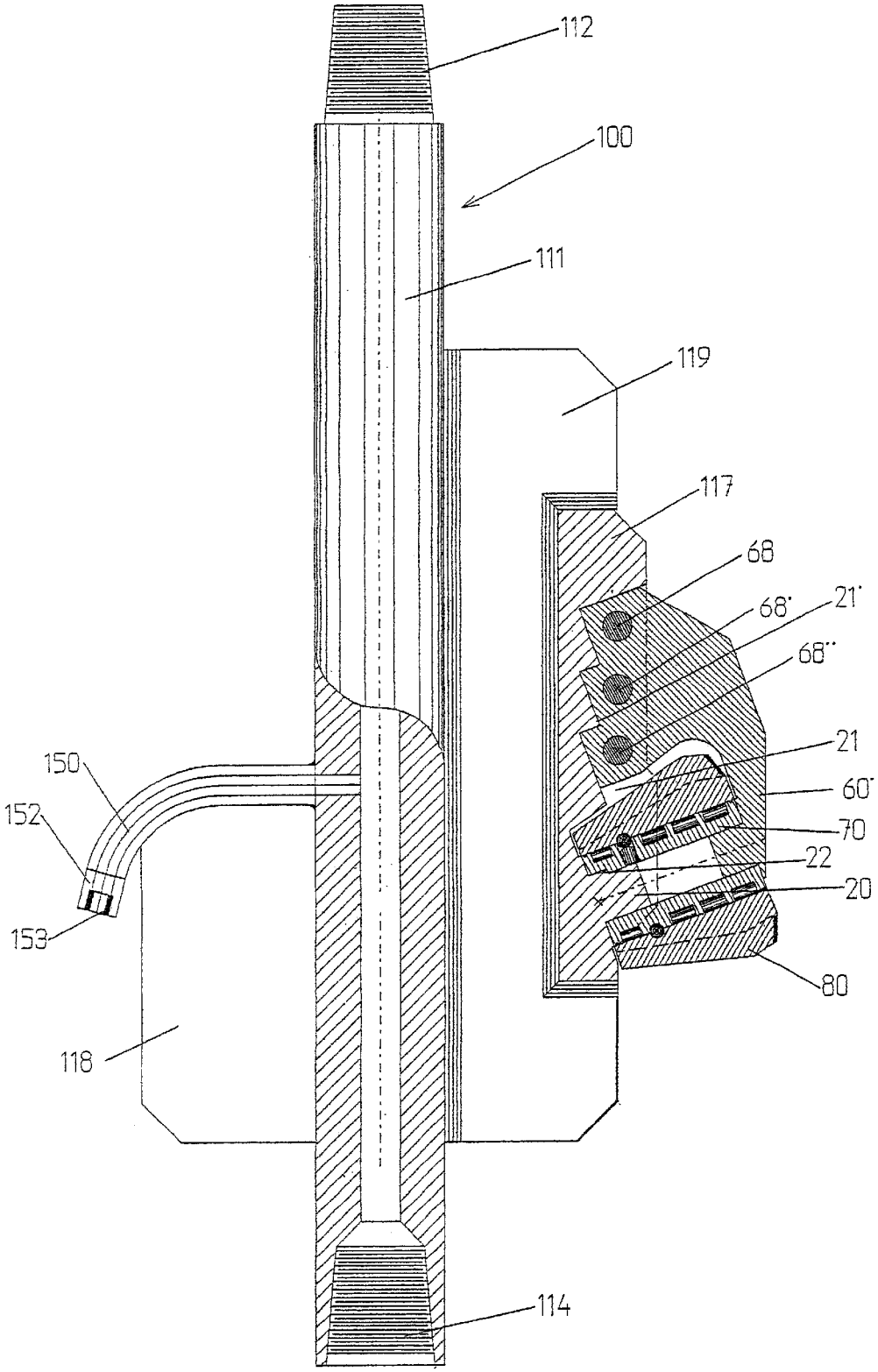
FIG. 12 is a partial sectional view of the large diameter opener showing the attachment of the cutter arm secured to the body by the pins.

FIG. 8 is a view of the preferred embodiment of the hole opener with the support arms removably connected to the larger diameter portion 19 of body 11 by pins 68, 68', and 68". As may be more clearly seen from cross-sectional view shown in FIG. 11, pin 68 is inserted in the enlarged portion 19 of body 11 through passage intersecting the stair-stepped groove 21. Pin 68 is formed by any material of sufficient strength to secure arm 30' in said groove 21 in a manner well known to those skilled in the art of manufacture of drilling equipment. A cap head bolt 69 is inserted in a slot 69" formed in said body 19 to secure said pin in said body. A passage 69' is provided on the opposite side of body 19 of lesser diameter than the passage provided for the pin 68 to permit the knock-out removal of the pin by an operator to remove or change the cutter arm 30'. As may be readily appreciated from FIG. 8, three pins are disclosed to hold the cutter arm in the stair stepped groove. Greater or lesser number of pins may be formed in the enlarged portion 19 of the tool body 11 to accommodate differing service requirements and drilling or hole enlarging environments.

Figure 9:
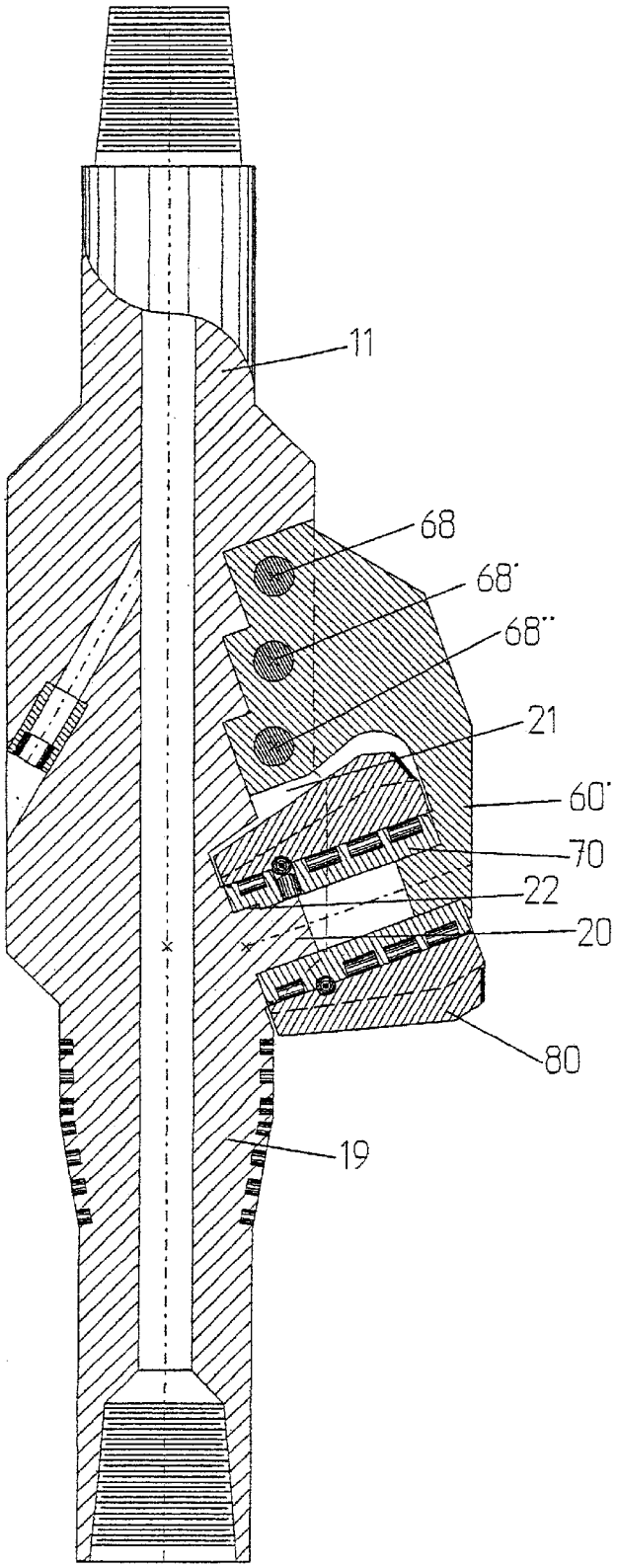
FIG. 9 is a sectional view of the second form of embodiment with a larger cutter arm and larger cutter cone.

In FIGS. 8 and 9, respectively, cutter arm 30' and 60' support cutter journals 28 and 70 and cutter bodies 25 and 80 in the same manner and operate in the same manner as the hole opener disclosed in FIGS. 1 and 2. The pins 68, 68' and 68" which are used to secure the cutter arms on the body in FIG. 8 are an alternative and preferred methods of attachment to the cap head bolts of FIG. 1 and 2.

Figure 10:
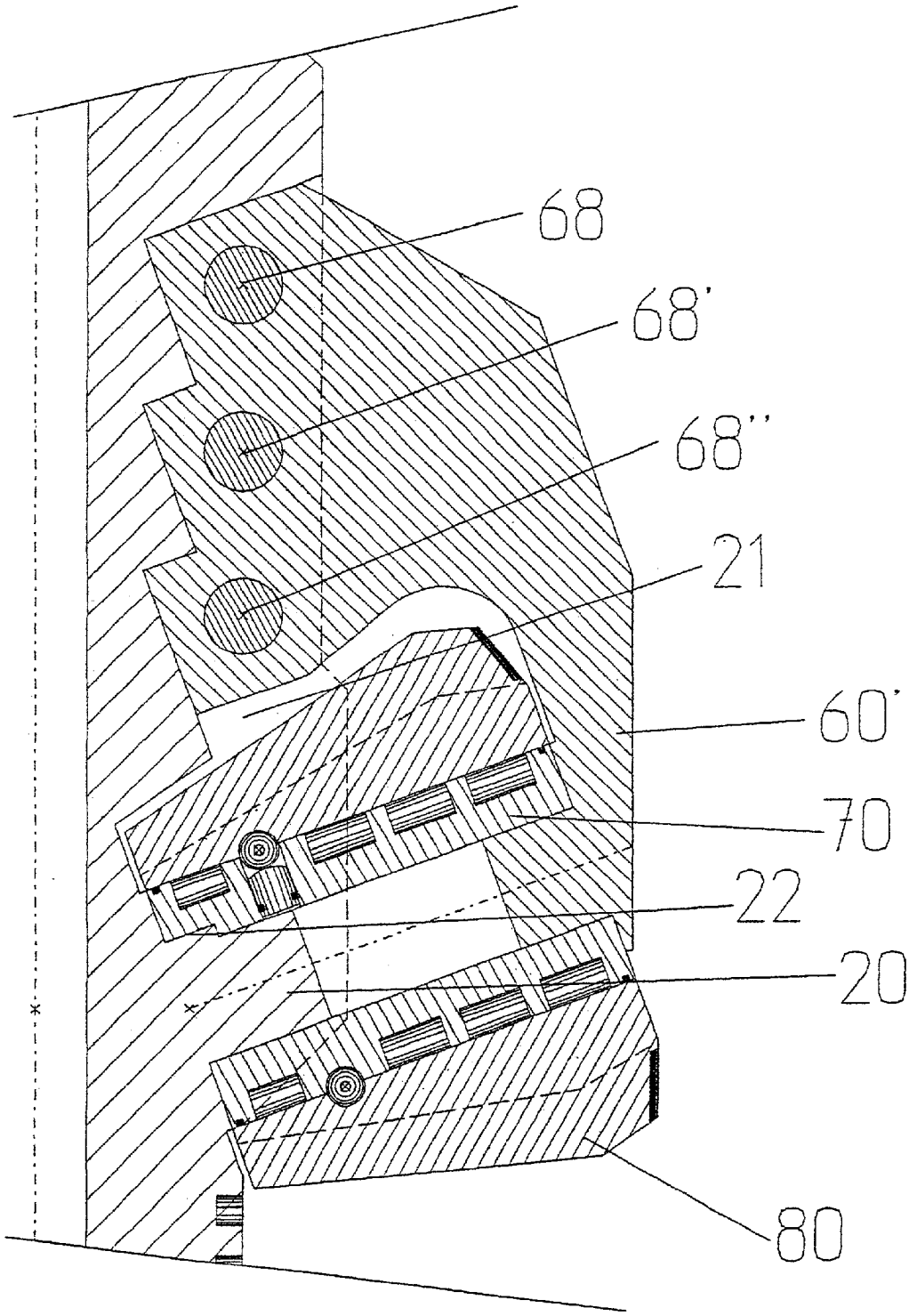
FIG. 10 is an enlarged cross-sectional view of the cutter support arm of FIG. 8.

FIG. 10 is an expanded view of spindle support arm 60' mounted on the expanded portion 19 of body 11 (as in FIGS. 1 and 2) with a larger cutter 80 and journal body 70 to permit a larger diameter hole to be enlarged utilizing the same tubular body 11.

It may be appreciated that the cutter support arm of each FIGS. 1, 2, 3, 7, 8, 9 and 12, may be attached in a number of ways to the tubular body (or to the spindle support block of FIG. 7 and 12) without departing from the disclosure and intent of the present invention. For example, the pins 68, 68' and 68" could have alternatively been bolts or cap head screws with locking bolts or cap head screws. Additionally, the proximal end of the cutter support spindle might be affixed in a recess provided in the body 11 and either pinned or bolted by one or more screws onto the surface of the expanded body surface 19.

Figure 13:
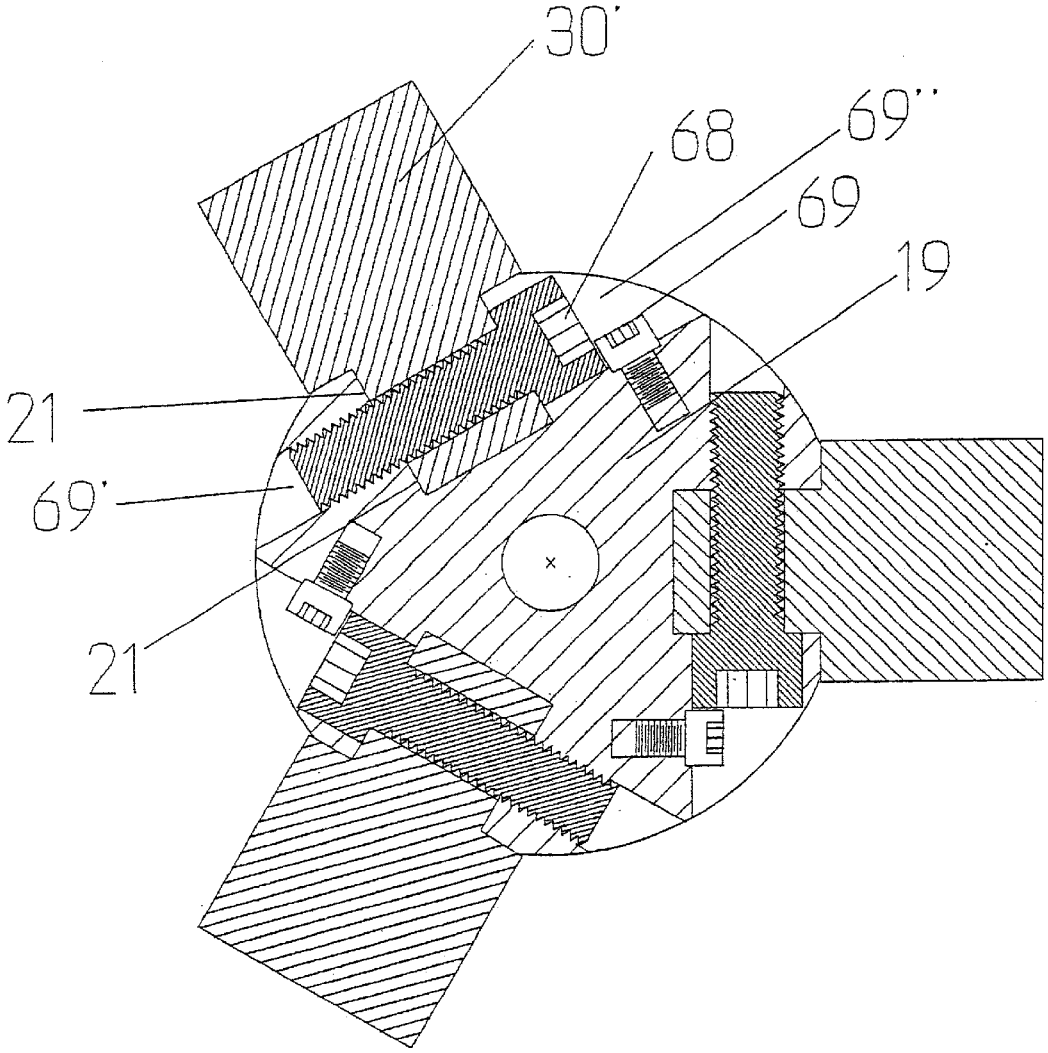
FIG. 13 is a partial sectional view of the large diameter opener showing an alternative attachment of the cutter arm secured to the body by cap head screws and secured by smaller diameter cap head screws.

In FIG. 13, an alternative embodiment of the cutter support arm connection is disclosed. Body 19 is tapped to provide threads at 150 for seating cap head screws 168. A cap head screw 168 is inserted in the body 19 and through the hole machined into the proximal end of the cutter support arm 30' and into the threaded body portion 150. The cap head screw 168 seating in the threads 150 provides additional support for the cutter arm assembly and lessens the chance of fatigue failure from movement of the arm in the body. A smaller cap head screw 69 is seated adjacent the head of the cutter arm support cap head screw 168 to prevent loosening of the cap head screw 168 during operation.

Figures 14, 14A:
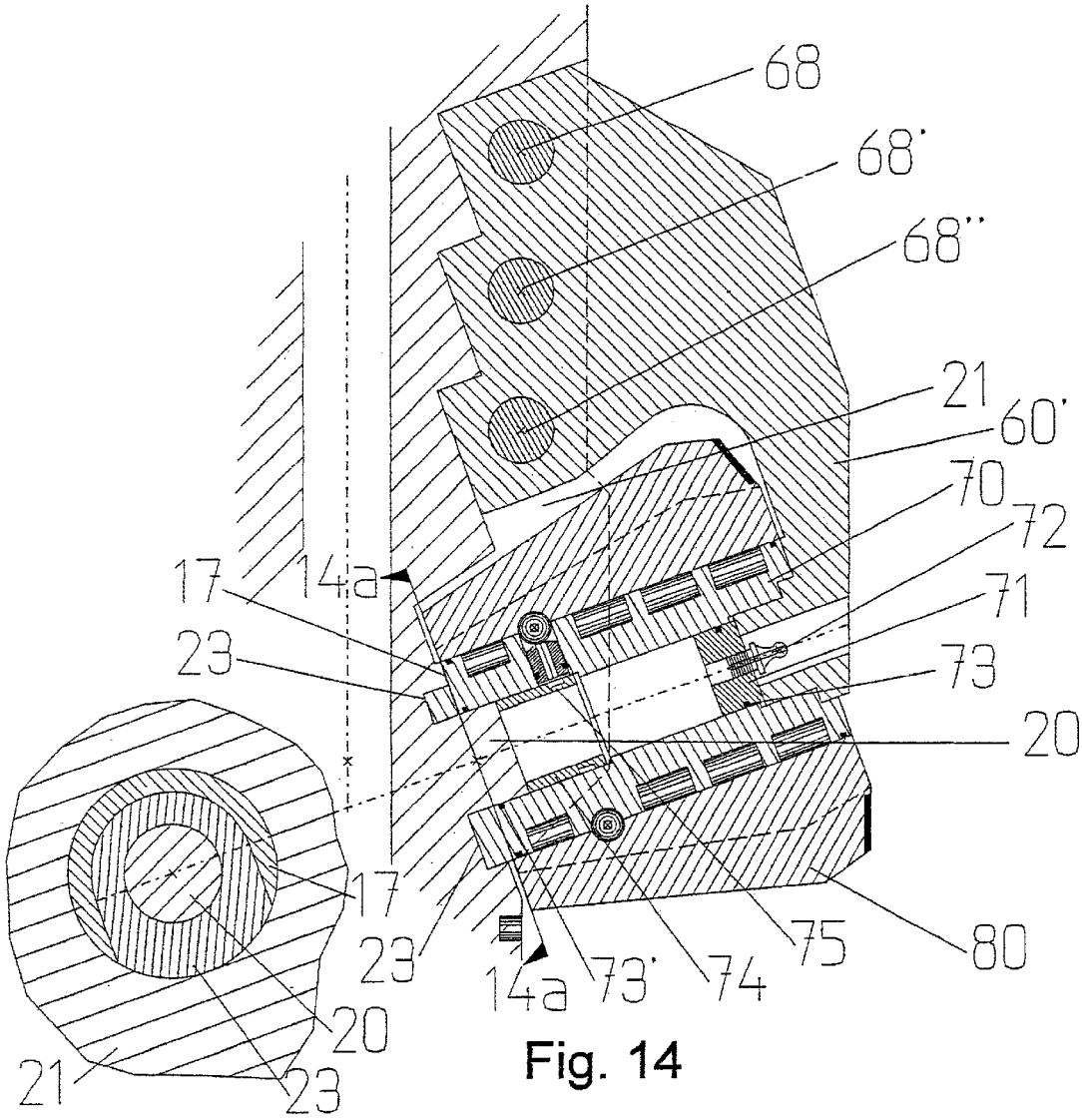
FIG. 14 is a partial sectional view of another embodiment of the large diameter opener having a recessed seat for the journal body for strength and rigidity and further providing a lubrication reservoir and system for lubricating the bearings during operation.
FIG. 14*a* is a cross-sectional view of the recessed groove area formed on the body of the hole opener.

FIG. 14 shows an alternative embodiment of the opener in which the body 19 is provided with a recess 23 into which is fitted the proximal end of the cutter body journal 70. The profile shown in FIG. 14 provides rigidity and support for the journal 70 and allows the load placed on the cutter to be more evenly distributed to the body 19. A cross-sectional view in FIG. 14*a* shows the spatial relationship of the spindle 20, the non-concentric recess 23, and the upraised surface 17 against which the proximal end of the journal 20 is seated and supported off of the surface of groove 21. The recess prohibits the movement of the journal which is urged into movement by the movement of the cutter shell around the center post or spindle 20 of the profile thereby reducing the wear on the journal surfaces which mate with the enlarged portion 19 of the opener body 11 and increasing the life of the journal 70. In this alternative embodiment, the journal body provides a longitudinal pathway through and is fitted with a grease plug 71 and grease nipple 72 in a manner well known to those in the industry, which provides a grease reservoir to provide lubrication during operation. The proximal end of the journal body 70 is fitted with a slotted retainer sleeve 73, which prevents the bearing plug 24 in the body of the journal 70, while at the same time allowing communication of grease from the reservoir to the bearing race.

After the cutter body 80 and journal 70 are assembled and mounted on the spindle 20 and secured by cutter arm 60, grease is injected through the nipple 72 and into the reservoir between the floating grease plug 71 and the top of the spindle 20. The distal end of the cutter support arm 60 is machined to provide a path for a standard grease gun, in a manner well known to those in the industry. The floating grease plug 71 is assembled with a seal 73 which fits in a groove provided on the surface of the plug 71, providing sealing engagement of the floating grease plug 71 with the interior surface of the journal body 70. Grease is retained within the reservoir and bearing surfaces by seal 73' seated in a groove on the inner periphery of journal body 70, which seals against the exterior surface of spindle 20. Seals are also provided for grooves machined on the exterior surface of the journal body 70 to prevent ingress of drilling fluid into the bearing surfaces in a manner well known to those in this industry.

Grooves are provided in the journal and bearing race to allow lubrication to occur during operation. The floating grease plug 71 balances the pressure acting on the grease reservoir and the bearing surfaces. As hydrostatic pressure builds against the seal surfaces around the bearings a proportionate pressure moves the floating grease plug 71 down the reservoir to balance the pressure on the interior of the reservoir and bearing surfaces. As the volume of lubricant changes during operation of the cutter, the equalizing pressure also forces the lubricant from the reservoir and around the bearings thereby extending bearing life.

These lubrication features may be used on hole openers with either cap headed screw as described in FIGS. 1, 2, 3, 6, or with pins or screw supports as described in FIGS. 8, 9, 10, and 12.

The present invention permits multiple hole sizes to be worked with one body. The support arm arrangement provides a safe, expedient means for changing the size of the hole sought to be enlarged without significant loss of time. The pin, which supported the spindle of the cutter found in many prior art devices, has been eliminated and the journal, which carries the cutter shell, is supported on both ends minimizing the bending moment associated with prior hole opener devices. The interchangeability of cutter support arms provides an efficient economic means for using a single tool for a variety of hole sizes.

What is claimed is:

1. A hole opener arrangement for enlarging a well bore comprising:

a tubular body providing at least three longitudinal grooves at spaced intervals around said body, a body spindle formed on said body adjacent each of said at least three grooves, a support arm removably attached to said body disposed in said at least three grooves providing a support spindle, journals, each journal retained between the body and a respective support arm and engaging a respective body spindle on the body at said journal's proximal end and also engaging a respective support spindle on the attached support arm at said journal's distal end, and a cutter body carried on each such journal to provide rotational contact with the bore to be enlarged.

2. A hole opener arrangement for enlarging a well bore comprising:

a tubular body providing at least three longitudinal grooves at spaced intervals around said body, a spindle formed on said body adjacent each of said at least three grooves, a support arm removably attached to said body disposed in said at least three grooves providing a support spindle, a journal retained between said spindle on the body at said journal's proximal end and the support spindle on the attached support arm at said journal's distal end, and a cutter body carried on each such journal to provide rotational contact with the bore to be enlarged, wherein the body spindle formed on said body in a non-concentric recess in the body whereby the proximal end of the journal seats in said non-concentric recess to prevent rotation around the body spindle.

3. A hole opener arrangement for enlarging a well bore comprising:

a tubular body providing at least three longitudinal grooves at spaced intervals around said body, a spindle formed on said body adjacent each of said at least three grooves, a support arm removably attached to said body disposed in said at least three grooves providing a support spindle, a journal retained between said spindle on the body at said journal's proximal end and the support spindle on the attached support arm at said journal's distal end, and a cutter body carried on each such journal to provide rotational contact with the bore to be enlarged, wherein the body spindle formed on said body is eccentric whereby the journal cannot rotate around the body spindle.

4. The hole opener arrangement as in claim 1,2, or 3 wherein the support arm is removably attached to the body of the hole opener by a plurality of pins.

5. The hole opener arrangement as in claim 1, 2, or 3 wherein the support arm is removably attached to the body of the hole opener by a plurality of screws.

6. The hole opener arrangement as in claim 1 wherein each journal provides an interior longitudinal passage and a bearing race on its external surface to facilitate rotational movement of the cutter body on said journal.

7. The hole opener arrangement as in claim 2 wherein each journal provides an interior longitudinal passage and a bearing race on its external surface to facilitate rotational movement of the cutter body on said journal.

8. The hole opener arrangement as in claim 3 wherein each journal provides an interior longitudinal passage and a bearing race on its external surface to facilitate rotational movement of the cutter body on said journal.

9. A hole opener comprising:

a tubular body providing a passageway for communication of fluid and a plurality of longitudinal grooves on the surface of said tubular body, cutter journal spindles formed on said tubular body, a plurality of removable cutter support arms, each with a support spindle, fasteners for said removable cutter support arms on said tubular body, cutter journals, each supported on a respective support spindle and cutter journal spindle between each of the cutter support arms and the tubular body, and replaceable cutter shells rotatably supported on said cutter journals.

10. The hole opener of claim 9 wherein the plurality of removable cutter support arms having a dorsal side are attached to the hole opener by cap head screws from the dorsal side of the cutter support arm.

11. The hole opener of claim 9 wherein said cutter journal provides an interior longitudinal passage and a bearing race on its external surface to facilitate rotational movement of the cutter body on said journal.

12. A hole opener comprising:

a tubular body providing a passageway for communication of fluid and a plurality of longitudinal grooves on the surface of said tubular body, cutter journal spindles formed on said tubular body, a plurality of removable cutter support arms, fasteners for said removable cutter support arms on said tubular body, cutter journals supported between each of the cutter support arms and the cutter journal spindles formed on the tubular body, and replaceable cutter shells rotatably supported on said cutter journals, wherein the cutter support arms have lateral faces, wherein the fasteners are bolts inserted into holes drilled into said lateral faces of each cutter support arm, and are secured by small cap head screws to prevent loss during operation.

13. A hole opener comprising:

a tubular body providing a passageway for communication of fluid and a plurality of longitudinal grooves on the surface of said tubular body, cutter journal spindles formed on said tubular body, a plurality of removable cutter support arms, fasteners for said removable cutter support arms on said tubular body, cutter journal supported between each of the cutter support arms and the cutter journal spindles formed on the tubular body, and replaceable cutter shells rotatably supported on said cutter journals, wherein each groove has lateral sides and each cutter support arm has lateral faces, wherein the fasteners are cap head screws connected through passageways formed in the lateral sides of each groove and passing through holes drilled into the lateral faces of each cutter support arm, each cap head screw secured by a small cap head screw to prevent loss during operation.

14. A hole opener comprising:

a tubular body providing a passageway through its longitudinal length for communication of fluid, threaded connections on each end of the tubular body, not less than three grooves formed on the tubular body, each groove having a first plurality of steps formed therein, a stepped cutter support arm having a distal end and a proximal end with a second plurality of steps on one side of the proximal end, the stepped cutter support arm for insertion into each of the not less than three grooves on the tubular body with the first and second plurality of steps positioned in a mating relationship with each other, and providing a support spindle at each distal end of such arm, at least one fastener for each stepped cutter support arm to the body, not less than three journals each having an interior surface, an interior diameter, a proximal end, a distal end and an external surface, each such journal providing a longitudinal passage on its interior surface and a bearing race on its external surface, and a body spindle formed on the tubular body for each groove, wherein each body spindle and support spindle has a diameter substantially equivalent to the interior diameter of each journal, wherein for each journal the respective body spindle supports the proximal end of such journal and the respective support spindle supports the distal end of such journal.

15. A hole opener as in claim 14 further comprising:

a jetting port and jetting nozzle to direct drilling fluid from the longitudinal passage of the hole opener to the exterior of the body.

16. A hole opener as in claim 6, 7, 8, 11, or 14 further comprising:

a grease plug and grease nipple sealingly and moveable engaged on the interior wall of the longitudinal passage of each journal, a seal seated on the inner periphery of the proximal end of each journal to seal against the surface of each body spindle, and a passage from the interior of the journal body to the bearing race to permit communication of lubricant from a reservoir formed in the longitudinal passageway of the journal by the top of each body spindle and the bottom of each grease plug and grease nipple.

* * * * *